US008062103B2

(12) United States Patent
Muldowney

(10) Patent No.: US 8,062,103 B2
(45) Date of Patent: Nov. 22, 2011

(54) HIGH-RATE GROOVE PATTERN

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 591 days.

(21) Appl. No.: 12/317,572

(22) Filed: Dec. 23, 2008

(65) Prior Publication Data

US 2010/0159811 A1 Jun. 24, 2010

(51) Int. Cl.
*B24B 7/22* (2006.01)

(52) U.S. Cl. ..... 451/527; 451/41; 451/530; 451/921

(58) Field of Classification Search ..... 451/527, 451/530, 533, 921, 56, 41, 59, 63, 287, 288, 451/526
See application file for complete search history.

(56) References Cited

U.S. PATENT DOCUMENTS

| | | | | |
|---|---|---|---|---|
| 6,843,711 | B1 * | 1/2005 | Muldowney | 451/527 |
| 7,059,949 | B1 * | 6/2006 | Elmufdi et al. | 451/527 |
| 7,059,950 | B1 * | 6/2006 | Muldowney | 451/527 |
| 7,131,895 | B2 * | 11/2006 | Elmufdi et al. | 451/103 |
| 7,182,677 | B2 * | 2/2007 | Donohue et al. | 451/287 |
| 7,267,610 | B1 * | 9/2007 | Elmufdi et al. | 451/530 |
| 7,300,340 | B1 * | 11/2007 | Elmufdi et al. | 451/527 |
| 7,311,590 | B1 * | 12/2007 | Muldowney | 451/526 |
| 7,329,174 | B2 * | 2/2008 | Hosaka et al. | 451/527 |
| 7,520,798 | B2 * | 4/2009 | Muldowney | 451/285 |
| 2008/0182489 | A1 | 7/2008 | Muldowney | |
| 2008/0182493 | A1 | 7/2008 | Muldowney | |

* cited by examiner

*Primary Examiner* — Robert Rose
(74) *Attorney, Agent, or Firm* — Blake T. Biederman

(57) ABSTRACT

The invention provides a polishing pad useful for polishing at least one of a magnetic, optical and semiconductor substrate in the presence of a polishing medium with a polishing pad. The polishing pad comprises a center, an inner region surrounding the center, a transition region connecting grooves from the inner region to an outer region surrounding the inner region. The outer region has multiple grooves with a high-rate path. The transition region is adjacent the outer region and within a radius from the center defined as follows:

$$r_{TR} = 0.7r^* \text{ to } 1.3r^*$$

where $$r^* = R_C\sqrt{\left(\frac{R}{R_C}\right)^2 - \cos(2\theta_{c0}) - \sin(2\theta_{c0})\sqrt{\left(\frac{R/R_C}{\cos\theta_{c0}}\right)^2 - 1}}\ ;$$

with the inner region originating continuous grooves that extend uninterrupted to the outer region.

10 Claims, 15 Drawing Sheets

HIGH-RATE GROOVE PATTERN

BACKGROUND OF THE INVENTION

The present invention generally relates to the field of polishing pads for chemical mechanical polishing (CMP). In particular, the present invention is directed to polishing pad grooves that improve polishing performance.

In the fabrication of integrated circuits and other electronic devices on a semiconductor wafer, multiple layers of conducting, semiconducting and dielectric materials are deposited onto and etched from the wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization or adjust polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another. These groove patterns and configurations, however, overlook the utilization of slurry related to CMP polishers having active wafer carrier rings.

Recently, G. P. Muldowney, in US Pat. Pub. No. 2008/0182493, disclosed a low-slurry groove that functions by aligning polishing pad grooves with carrier grooves over a plurality of locations to increase slurry utilization. This patent teaches polishing pad and carrier ring combinations that reduce the squeegee effect at the leading edge of the wafer, wherein much of the film of liquid, e.g., slurry, on the pad texture is swept off by the carrier ring. The patent further states that "The loss of this potentially usable slurry may reduce the effectiveness and predictability of the polishing process, while resulting in significant additional process costs."

While the low-slurry groove pattern of Muldowney increases slurry utilization and reduces the squeegee effect, there remains a need for CMP polishing processes that provide effective removal rate with improved polishing performance. Polishing pad designers are continually seeking groove patterns and polishing methods that increase removal rate for increasing tool throughput and facilitate improved polishing performance for increasing wafer yields.

STATEMENT OF THE INVENTION

In one aspect, the invention provides a polishing pad useful for polishing at least one of a magnetic, optical and semiconductor substrate in the presence of a polishing medium with a polishing pad, the polishing pad comprising: a center, an inner region surrounding the center, a transition region connecting grooves from the inner region to an outer region surrounding the inner region, the outer region having multiple grooves, the multiple grooves having a high-rate path, at least fifty percent of the high-rate path being within twenty percent of a groove trajectory $\phi(r)$ in polar coordinates referenced to the concentric center of the polishing pad and defined in terms of (1) the distance R between the concentric center of the polishing pad and the rotational center of the substrate being polished, (2) the radius $R_c$ of the carrier fixture, and (3) the local angle $\theta_{c0}$ of grooves in the carrier fixture, defined with a groove equation as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ the transition region being adjacent the outer region and within a radius from the center defined as follows:

$$r_{TR} = 0.7r^* \text{ to } 1.3r^*$$

where $$r^* = R_C\sqrt{\left(\frac{R}{R_C}\right)^2 - \cos(2\theta_{c0}) - \sin(2\theta_{c0})\sqrt{\left(\frac{R/R_C}{\cos\theta_{c0}}\right)^2 - 1}}\ ;$$

and wherein the inner region originates continuous grooves that extend uninterrupted to the outer region.

In another aspect, the invention provides a polishing pad useful for polishing at least one of a magnetic, optical and semiconductor substrate in the presence of a polishing medium with a polishing pad, the polishing pad comprising: a center, an inner region surrounding the center, a transition region connecting grooves from the inner region to an outer region surrounding the inner region, the outer region having multiple grooves, the multiple grooves having a high-rate path, at least fifty percent of the high-rate path being within ten percent of a groove trajectory $\phi(r)$ in polar coordinates referenced to the concentric center of the polishing pad and defined in terms of (1) the distance R between the concentric center of the polishing pad and the rotational center of the substrate being polished, (2) the radius $R_c$ of the carrier fixture, and (3) the local angle $\theta_{c0}$ of grooves in the carrier fixture, defined with a groove equation as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ the transition region being adjacent the outer region and within a radius from the center defined as follows:

$$r_{TR} = 0.8r^* \text{ to } 1.2r^*$$

where $$r^* = R_C\sqrt{\left(\frac{R}{R_C}\right)^2 - \cos(2\theta_{c0}) - \sin(2\theta_{c0})\sqrt{\left(\frac{R/R_C}{\cos\theta_{c0}}\right)^2 - 1}}\ ;$$

and wherein the inner region originates continuous grooves that extend uninterrupted to the outer region and the transition region has an $\text{Area}_{Groove}/\text{Area}_{Total}$ of 25 to 75 percent.

DETAILED DESCRIPTION OF THE INVENTION

It has been discovered that CMP polishing pads having a three-region groove structure can improve rate and polishing uniformity. The polishing pad uses a three-region groove structure that includes an outer high-rate region, a transition region and an inner region. The transition region has a defined location where continuous uninterrupted grooves connect inner region grooves to outer region grooves. These three regions combine to provide a high-rate polishing pad with improved within-wafer polishing uniformity.

Figure 1:
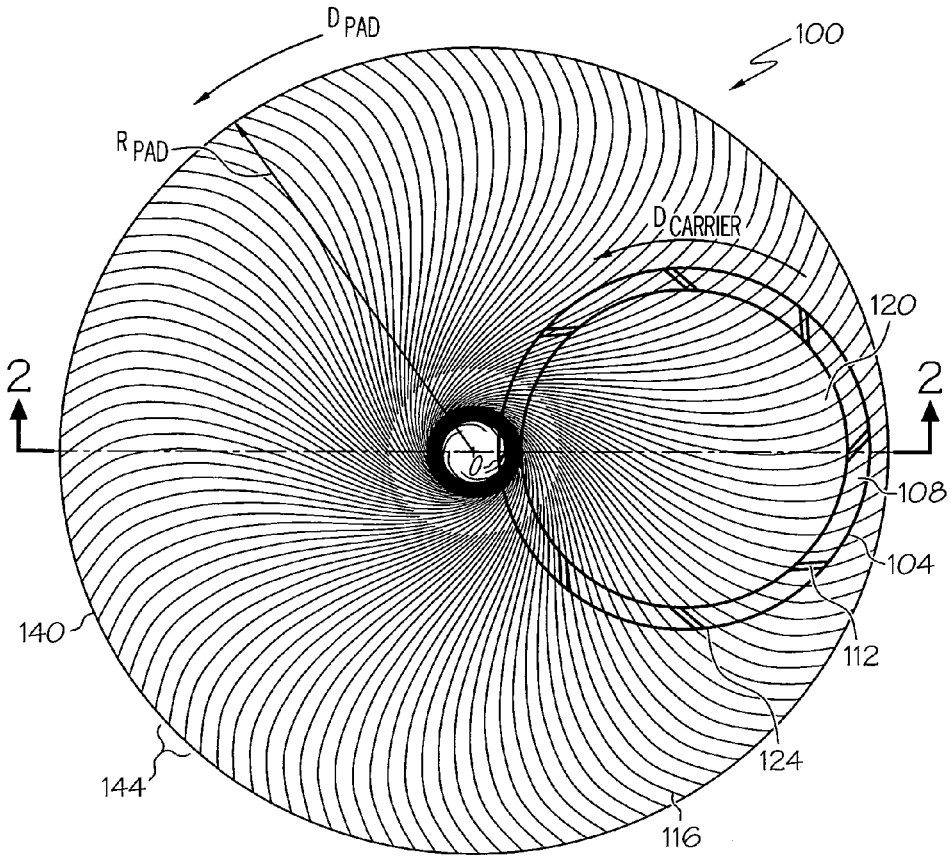
FIG. 1 is a schematic top view of a prior art polishing pad made for use with a grooved carrier ring.

Referring now to the drawings, FIG. 1 illustrates one embodiment of a polishing pad 100 made in accordance with the present invention. As discussed below, polishing pad 100 is particularly designed in coordination with a corresponding respective carrier 104, e.g., a wafer carrier, having a carrier ring 108 containing a plurality of carrier grooves 112 that confront the polishing pad during polishing. More particularly, polishing pad 100 includes a plurality of pad grooves 116 configured to cooperate with carrier grooves 112 so as to allow a polishing medium (not shown), e.g., slurry, to more readily reach an article being polished, e.g., semiconductor wafer 120, as the polishing pad sweeps beneath carrier 104. Generally, this cooperation between pad grooves 116 and carrier grooves 112 occurs in the form of ones of the pad grooves and carrier grooves aligning with one another along at least a portion of the leading edge 124 as polishing pad 100 and carrier 104 are rotated in predetermined directions $D_{Pad}$, $D_{Carrier}$, respectively. For purposes of this specification, alignment of the pad grooves and carrier grooves refers to an instantaneous condition during polishing where a continuous path is formed from the polishing pad surface outside the carrier ring to the substrate inside the carrier ring by the overlap of the entire length of a carrier ring groove over at least part of its width with a polishing pad groove such that the available height of the flow channel for polishing medium passing from the outside to the inside of the carrier ring is greater than the height of the carrier groove alone. The alignment of pad grooves 116 and carrier grooves 112 effectively provides larger flow passages across carrier ring 108, due to the adding of the groove volumes of the respective grooves that occurs when the two grooves are in alignment, than would occur without such alignment. Details of various exemplary geometries of pad grooves 116 on polishing pad 100 to suit various geometries of carrier grooves 112 on carrier ring 108 are described below. However, prior to describing the derivation of the geometry of pad grooves 116 and other similar grooves in the exemplary alternative embodiments, some of the physical properties of polishing pad 100 are described next.

Figure 2:
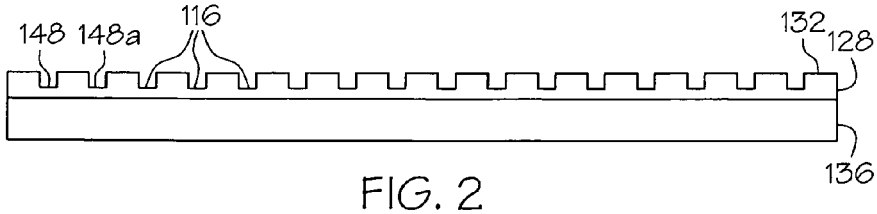
FIG. 2 is an exaggerated cross-sectional view of the polishing pad of FIG. 1 showing as taken along line 2-2 of FIG. 1.

Referring to FIG. 2, and also to FIG. 1, polishing pad 100 may further include a polishing layer 128 having a polishing surface 132. In one example, polishing layer 128 may be supported by a backing layer 136, which may be formed integrally with polishing layer 128 or may be formed separately from polishing layer 128. Polishing pad 100 typically has a circular disk shape so that polishing surface 132 has a concentric center O and a circular outer periphery 140. The latter may be located a radial distance from O, as illustrated by radius $R_{Pad}$ of a particular length. At least a portion of the carrier-compatible groove 116 has a radial or curved radial shape. For purposes of the specification, a radial or curved-radial shape is tangent to the radius $R_{Pad}$ of the polishing pad 100 in at least one location along the length of the radius $R_{Pad}$. Polishing layer 128 may be made out of any material suitable for polishing the article being polished, such as a semiconductor wafer, magnetic media article, e.g., a disk of a computer hard drive or an optic, e.g., a refractive lens, reflective lens, planar reflector or transparent planar article, among others. Examples of materials for polishing layer 128 include, for the sake of illustration and not limitation, various polymer plastics, such as a polyurethane, polybutadiene, polycarbonate and polymethylacrylate, among many others.

Pad grooves 116 may be arranged on polishing surface 132 in any of a number of suitable manners. In one example, pad grooves 116 may be the result of repeating a single groove shape circumferentially around concentric center O, e.g., using a constant angular pitch. In another example, which is shown in FIG. 1, pad grooves 116 may be arranged in at least one groove set 144 that is repeated circumferentially around concentric center O, e.g., at a constant angular pitch. In one example, groove set 144 comprises a plurality of individual pad grooves 116 that share a similar shape, but that extend different amounts. Advantageously, the individual pad grooves 116 are distinct with spacing between adjacent grooves. It is possible for these grooves to intersect with another groove, such as a circular, spiral or X-Y groove. Advantageously, however, these adjacent grooves do not intersect with other grooves in the wafer track. As will be appreciated, due to the circular nature of polishing pad 100, the spacing between multiple grooves that extend from proximate concentric center O of the pad near or to the outer periphery of the pad and that have a constant angular pitch naturally increases toward the outer periphery of the pad. Consequently, to provide more uniform grooving, in some designs it is desirable to provide polishing pad 100 with more, but shorter, pad grooves 116 when the spacing exceeds a certain amount. It will be readily appreciated that several of groove sets 144 may be formed around concentric center O, as desired.

Further, and referring to FIG. 2 in addition to FIG. 1, each of the plurality of grooves 116 may be formed in polishing layer 132 in any suitable manner, such as by milling, molding, laser cutting, etc. Each of the plurality of pad grooves 116 may be formed with a cross-sectional shape 148 as desired to suit a particular set of design criteria. In one example, each of the plurality of pad grooves 116 may have a rectangular cross-sectional shape, e.g., groove cross-sectional shape 148*a* (FIG. 2). In another example, cross-sectional shape 148 of each pad groove 116 may vary along the length of the groove. In yet another example, cross-sectional shape 148 may vary from one pad groove 116 to another. In still another example, if multiple groove sets 144 are provided, cross-sectional shape 148 may vary from one groove set to another. Those having ordinary skill in the art will understand the wide range of cross-sectional shapes that a designer has in executing cross-sectional shape 148 of pad grooves 116.

Figure 3:
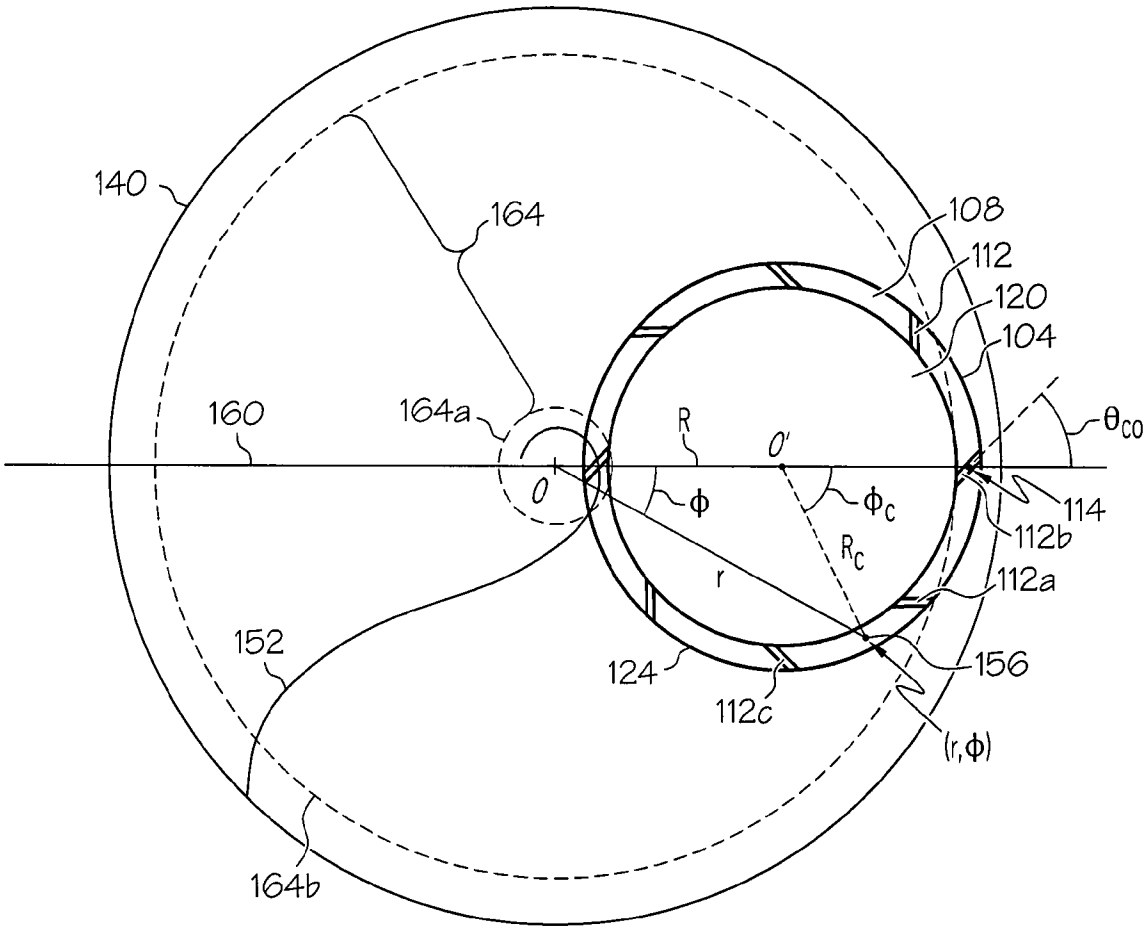
FIG. 3 is a schematic top view of the polishing pad of FIG. 1 that includes geometry used to generate the groove path for the polishing pad of the invention.

Referring now to FIGS. 1 to 3, each pad groove 116 (FIG. 1) is provided with a carrier-compatible groove shape 152. At a high level, carrier-compatible groove shape 152 may be defined by a plurality of points 156 that describe the direction, location and contour of each corresponding groove 116. Each of points 156 may be located by an angle $\phi$ formed between an axis, such as, for example, a horizontal axis 160, and a radius r projecting from concentric center O of polishing pad 100. In one example, carrier-compatible groove shape 152 may be defined over the entire, or substantially the entire, radial distance of polishing surface 132, i.e., $R_{Pad}$. In another example, carrier-compatible groove shape 152 may be defined in relation to the location of the article being polished, e.g., wafer 120. In yet another example, carrier-compatible groove shape 152 may be defined within a portion of a polishing track 164 on polishing surface 132 (FIG. 2), i.e., the region of the polishing surface that confronts wafer 120, or other article being polished, during polishing. Typically, the carrier-compatible groove occupies at least fifty percent of the wafer track as measured in a radial direction from the center O. Advantageously, the carrier compatible groove occupies at least two-thirds of the wafer track as measured in a radial direction from the center O. Most advantageously, the carrier compatible groove occupies the entire wafer track. Polishing track 164 may be defined by an inner boundary 164*a* and an outer boundary 164*b*. Those having ordinary skill in the art will readily appreciate that, although inner and outer boundaries 164*a*, 164*b* are largely circular, these boundaries may be undulated in the case of a polisher that imparts an orbital or oscillatory motion to the polished article or polishing pad 100.

Carrier-compatible groove shape 152 is defined as a function of three geometric parameters. The first parameter is the distance R between concentric center O of polishing pad 100 and rotational center O' of substrate 120 being polished. In the case where carrier 104 oscillates in a plane perpendicular to its axis of rotation, the distance R is a periodic function of time and the value of R used to determine carrier-compatible groove shape 152 may be the minimum, the maximum, or an intermediate value; preferably the time-average value of R is used. The second parameter is the radius $R_c$ of carrier 104. Typically, carrier radius $R_c$ will denote the outer radius of carrier ring 108 as measured from rotational center O'. Those having ordinary skill in the art will appreciate, however, that carrier radius $R_c$ may alternatively denote a radial distance from rotational center O' to another location on carrier ring 108, such as, for example, the mid-width of carrier ring 108 or the inner radius of carrier ring 108, as illustrated in FIG. 3. The third parameter is the angle $\theta_{c0}$ of carrier grooves 112. Carrier grooves 112 may be considered to be oriented on carrier ring 108 in a manner that forms a local angle $\theta_c$ with an axis, such as, for example, horizontal axis 160. In this case, wherein carrier grooves 112 are oriented as shown, local angle $\theta_c$ of carrier groove 112*a* is 0°, local angle $\theta_c$ of carrier groove 112*b* is 45° and local angle $\theta_c$ of carrier groove 112*c* is −45°. Those skilled in the art will readily recognize how to determine local angle $\theta_c$ for the remaining ones of carrier grooves 112 shown. Local angle $\theta_c$ of carrier grooves of alternative carrier rings having alternative carrier groove orientations can readily be determined in the same manner. The base local angle $\theta_{c0}$ used to determine carrier-compatible groove shape 152 is the angle formed at the intersection point 114 where a carrier groove 112 crosses horizontal axis 160 at a distance corresponding to carrier radius $R_c$. As defined, base local angle $\theta_{c0}$ may be positive, negative, or zero.

Carrier-compatible groove shape 152 is well-defined everywhere within the width of polishing track 164, that is, at any radius equal to or greater than the radius of inner boundary 164*a* and less than or equal to the radius of outer boundary 164*b*. Inner boundary 164*a* may be defined by the radius $r=R-R_c$ drawn from concentric center O where r and R are time-averaged values if carrier 104 oscillates and fixed values otherwise. Outer boundary 164*b* may be defined by the radius $r=R+R_c$ drawn from concentric center O where r and R are time-averaged values if carrier 104 oscillates and fixed values otherwise. The values of r drawn from concentric center O which define carrier-compatible groove shape 152 thus span the interval of radius beginning at $(R-R_c)$ and ending at $(R+R_c)$. Outside this interval of radius, that is at values of r less than $(R-R_c)$ or greater than $(R+R_c)$, pad grooves 116 preferably follow a trajectory obtained by extrapolating carrier-compatible groove shape 152 at a slope equal or similar to the slope at the corresponding nearer boundary of polishing track 164.

Further, each point 156 along the portion, or whole, of carrier-compatible groove shape 152 may also be described by a carrier angle $\phi_c$ measured with respect to the rotational center O' of wafer carrier 104 located on horizontal axis 160, and subtended by the carrier radius $R_c$. A given point 156 may thus be located in terms of global polar coordinates (r, $\phi$) referenced to concentric center O or in terms of local polar coordinates ($R_c$, $\phi_c$) referenced to rotational center O'. From this geometric equivalence, it is possible to develop an expression for the trajectory of carrier-compatible grooves that provide an improvement in polishing performance, given by Equation 1 as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'} \qquad \text{Equation 1}$$

where $$\phi_c = \cos^{-1}\left(\frac{R^2 + R_C^2 - r^2}{2RR_C}\right) - \pi$$

for values of $r$ from $(R - R_C)$ to $(R + R_C)$.

An important feature of the trajectory given by Equation 1 is a singularity, that is an infinite derivative $d\phi/dr$, at a specific radius r* from the pad center. The radius of the singularity r* is the value of r where the denominator of the integral expression passes through zero, which may be determined to be given by Equation 2 as follows:

$$r^* = R_C\sqrt{\left(\frac{R}{R_C}\right)^2 - \cos(2\theta_{c0}) - \sin(2\theta_{c0})\sqrt{\left(\frac{R/R_C}{\cos\theta_{c0}}\right)^2 - 1}} \qquad \text{Equation 2}$$

Figure 4:
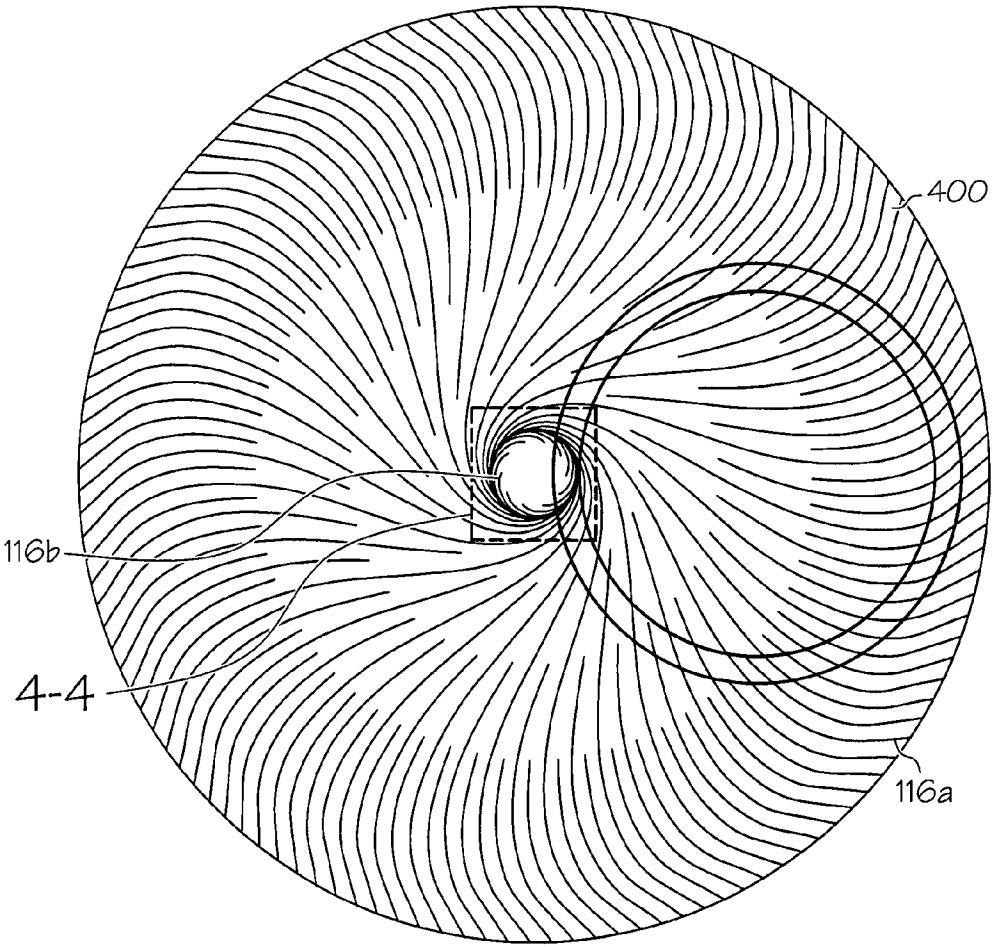
FIG. 4 is a schematic top view of the high-rate groove pattern of FIG. 1.
Figure 4A:
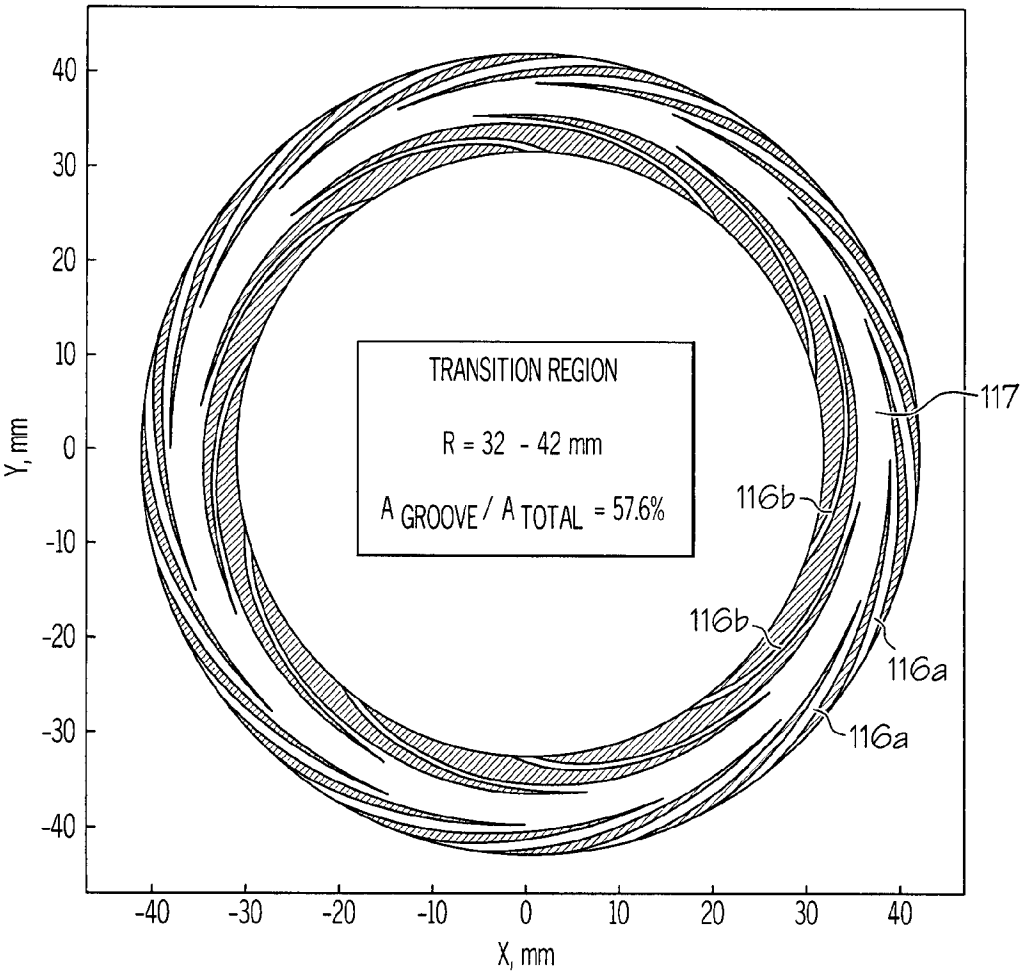
FIG. 4A is a schematic top view of a transition region for the high-rate groove pattern from within block 4-4 of FIG. 4.

The radius r* naturally partitions the full groove trajectory given by Equation 1 into an inner region and an outer region. It is also possible to identify a transition region between the inner region and the outer region wherein, approaching the radius r* from either side, a groove described by Equation 1 traverses a large range of angle $\phi$ over a very small interval of radius r, thus forming a tightly wound spiral. Very near the radius r*, adjacent windings of the spiral become closer together than the groove width and the grooves merge into a circular trough. In particular, FIGS. 4 and 4A illustrate the discontinuity in groove trajectory that occurs in the transition region within block 4-4 of polishing pad 400. In the transition region, grooves 116*a* approaching from the outer region and grooves 116*b* approaching from the inner region converge to form circular trough 117 having increased effective groove width. Grooves 116*a* and 116*b* are both given by Equation 1 and are part of the same trajectory, but at the radius r* given by Equation 2 they merge into circular trough 117 rather than maintaining a directly continuous flow path across this region.

It has been discovered that the high groove area naturally formed in the transition region of the trajectory given by Equation 1 is beneficial to CMP performance. The embodiment in FIGS. 4 and 4A has an $\text{Area}_{Groove}/\text{Area}_{Total}$ of 57.6%, and it can selectively alter polish rate in certain wafer regions to increase overall removal rate and decrease within-wafer-non-uniformity. However, the discontinuities in flow path across the transition region are not desirable, and the converging trajectories complicate manufacture of the polishing pad grooves because the thin tapering regions between the grooves are easily deformed. The preferred embodiment is therefore a three-region groove structure in which grooves in the inner region and the outer region make use of the trajectory given by Equation 1 while grooves in the transition region do not follow Equation 1 but are instead chosen to smoothly connect the paths of the grooves in the inner and outer regions and also to provide a high groove area across the transition region. Advantageously, the transition region occurs within a radius of $r_{TR}$=0.7r* to 1.3r*. Most advantageously, the transition region occurs within a radius of $r_{TR}$=0.8r* to 1.2r*. The transition region grooves may occupy all or a portion of the transition region, but the grooves do continue uninterrupted from at least the edge of the inner region, through the transition region and into the outer region. In addition, the transition region preferably has a groove surface area to total surface area of at least 25% [$\text{Area}_{Groove}/\text{Area}_{Total}$ of >25 percent]. For purposes of this specification, the surface ratio represents the surface area as measured at a plane of the polishing layer. Preferably, this area has a groove surface area to total surface area of 25 to 75% [$\text{Area}_{Groove}/\text{Area}_{Total}$ of 25 to 75 percent]. In addition, most preferably, the outer region and the transition region have the same groove surface area to total surface area ratios.

In the preferred embodiment, as the carrier ring 108 and polishing pad 100 rotate, each carrier groove 112 advantageously aligns with various ones of pad grooves 116*b* of the outer region at multiple locations adjacent the leading edge of the wafer 120. For example, the carrier grooves 112 may align with the pad grooves 116*b* of the outer region adjacent the leading edge of the wafer 120 at several distinct locations within the wafer track 164 at different points in time. When both the polishing pad 100 and carrier ring 108 rotate in a counterclockwise direction, the instantaneous point of alignment between a given one of pad grooves 116*b* of the outer region and sequential carrier grooves 112 will advantageously initiate near the transition region at a radius larger than $r_{TR}$, migrate outwardly across the wafer track 164 and then approach the periphery 140. Similarly, when both the polishing pad 100 and carrier ring 108 rotate in a clockwise direction, the instantaneous point of alignment between a given one of pad grooves 116*b* of the outer region and sequential carrier grooves 112 will advantageously initiate near the transition region at a radius larger than $r_{TR}$, migrate outwardly across the wafer track 164 and then approach the periphery 140.

Preferably the polishing occurs with the carrier fixture or ring 108 and polishing pad 100 rotating in the same direction. For instances where $\phi_c(r)$ is negative, both polishing pad 100 and carrier ring 108 rotate in a counterclockwise direction when viewed from above polishing surface 132. For instances where $\phi_c(r)$ is positive, both polishing pad 100 and carrier ring 108 rotate in a clockwise direction when viewed from above polishing surface 132. Advantageously, the polishing occurs with the high-rate groove path being within twenty percent of the above groove equation with a $\theta_{c0}$ of −90 to 90 degrees. For the purposes of this specification, within twenty percent of the equation means that the value of the global angle $\phi$ of the groove path at a given radius r referenced to concentric center O is between 0.8 and 1.2 times the value of the global angle $\phi$ computed using the above equation at the same radius r, and within ten percent of the equation means that the value of the global angle $\phi$ of the groove path at a given radius r referenced to concentric center O is between 0.9 and 1.1 times the value of the global angle $\phi$ computed using the above equation at the same radius r.

Most advantageously, the polishing occurs with the high-rate groove path within ten percent of the above groove equation with a $\theta_{c0}$ of −30 to 90 degrees. Furthermore, advantageously at least fifty percent of each high-rate groove path remains within twenty percent of the high-rate groove equation. Furthermore, most advantageously at least fifty percent of each high-rate groove path remains within ten percent of the high-rate groove equation. For purposes of the specification the percent of the high-rate groove path that remains within the equation refers to the radial percentage as measured from the concentric center O to the outer periphery 140. More advantageously, the polishing occurs with the high-rate path being within twenty percent of the groove equation with a $\theta_{c0}$ of 0 to 90 degrees. Most advantageously, the polishing occurs with the high-rate path being within twenty percent of the groove equation with a $\theta_{c0}$ of 30 to 60 degrees, such as 40 degrees, 45 degrees or 47.5 degrees. In particular, polishing has demonstrated excellent results with the high-rate path being within twenty percent of the groove equation with a $\theta_{c0}$ of 40 to 50 degrees.

Figure 5:
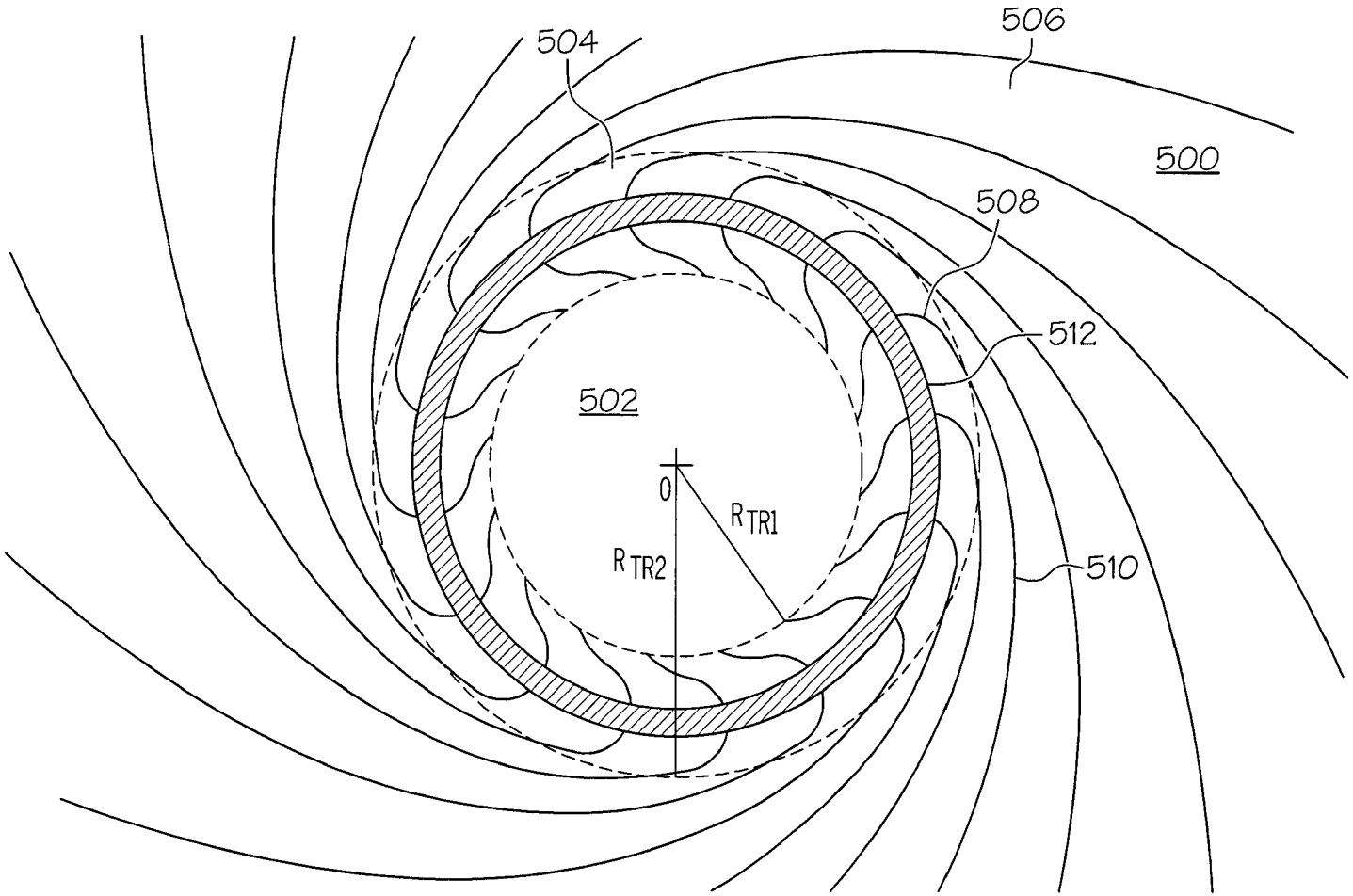
FIG. 5 is a high-rate groove pattern for insertion into block 4-4 of FIG. 4.

Referring to FIG. 5, polishing pad 500 has an inner region 502 encompassing the center of polishing pad 500 from the concentric center O out to the transition radius $R_{TR1}$. The inner region 502 optionally contains grooves, but may contain no grooves. The transition region 504 extends from $R_{TR1}$ to $R_{TR2}$. When the inner region 502 contains no grooves, it constitutes an ungrooved central landing and the outer diameter of the central landing originates the grooves of the transition region 504. In particular, each groove 508 initiates at $R_{TR1}$ and passes through $R_{TR2}$ into outer region 506. The groove 508 has an arc or U-shape in the transition region 504, then follows Equation 1 as groove 510 in the outer region 506—this is similar to the groove of FIG. 1. In addition, the transition region 504 contains wide circular groove 512 to ensure sufficient groove surface area and to balance the proportion of groove surface area between the transition region 504 and the outer region 506. In this case, circular groove 512 is characterized as wide because its width is greater than that of grooves 508 and 510.

Figure 5A:
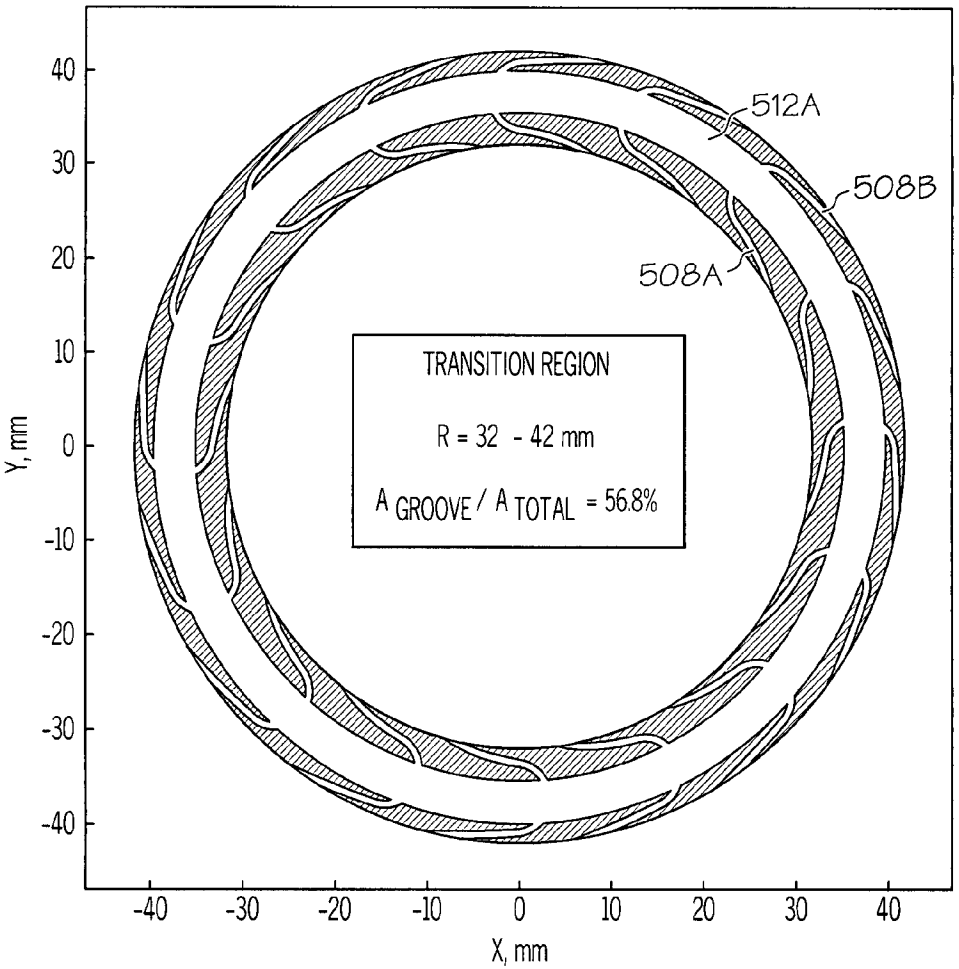
FIG. 5A is a schematic top view of a transition region of FIG. 5 with a wide circular groove and arc-shaped grooves.

FIG. 5A illustrates that an optional transition region embodiment with a wide circular groove 512A with a width of 4.0 mm may achieve an $Area_{Groove}/Area_{Total}$ of 56.8 percent with an $R_{TR1}$ of 32 mm and $R_{TR2}$ of 42 mm. In the transition region, grooves 508A and 508B represent corresponding arcs about wide circular groove 512A. In addition, the arcs of grooves 508A and 508B together form a continuous flow path across wide circular groove 512A. After extending through the transition region, grooves 508B continue through the outer region to the perimeter of the pad (not illustrated) in accordance with a groove path defined by Equation 1. Advantageously, the outer region will contain additional shorter grooves that originate from within the outer region to balance the $Area_{Groove}/Area_{Total}$ across the wafer track. Optionally, these grooves may have staggered starting locations, uneven angular groove spacings, repeating group patterns or any combination of these features.

Figure 5B:
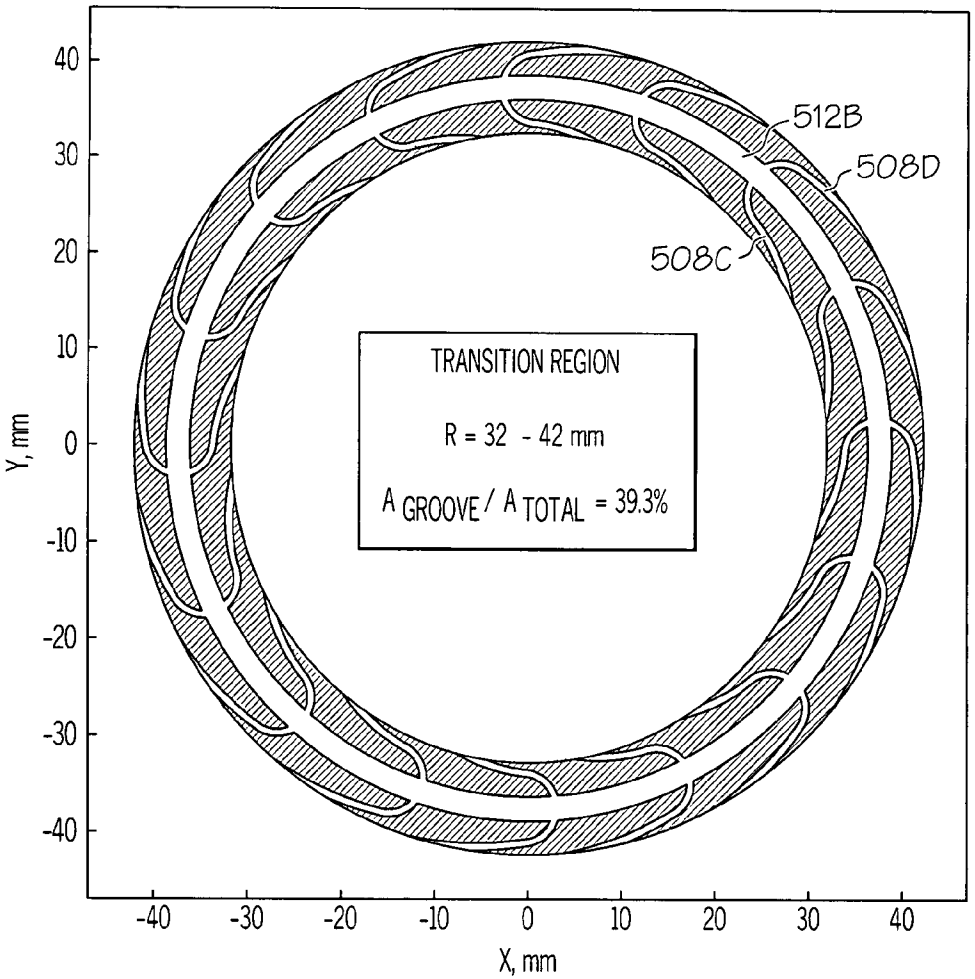
FIG. 5B is a schematic top view of a transition region of FIG. 5 with a narrow circular groove and arc-shaped grooves.

FIG. 5B illustrates that an optional transition region embodiment with a wide circular groove 512B with a width of 2.4 mm may achieve an $Area_{Groove}/Area_{Total}$ of 39.3 percent with an $R_{TR1}$ of 32 mm and $R_{TR2}$ of 42 mm. In the transition region, grooves 508C and 508D represent corresponding arcs about wide circular groove 512B. In addition, the arcs of grooves 508C and 508D together form a continuous flow path across wide circular groove 512B. After extending through the transition region, grooves 508D continue through the outer region to the perimeter of the pad (not illustrated) in accordance with a groove path defined by Equation 1. Advantageously, the outer region will contain additional shorter grooves that originate from within the outer region to balance the $Area_{Groove}/Area_{Total}$ across the wafer track. Optionally, these grooves may have staggered starting locations, uneven angular groove spacings, repeating group patterns or any combination of these features.

Figure 6:
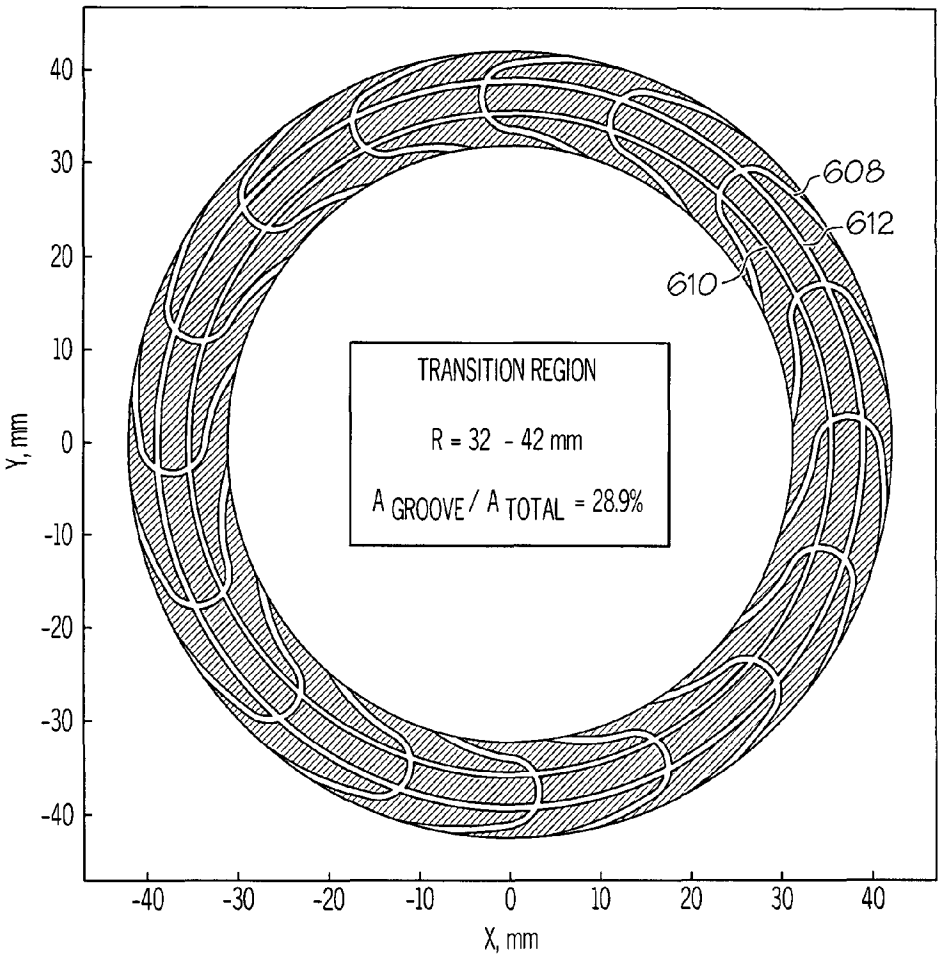
FIG. 6 is a schematic top view of a transition region having two circular grooves and arc-shaped grooves.

FIG. 6 illustrates that an optional transition region embodiment with two narrow circular grooves 610 and 612 with a width of 0.76 mm and a pitch of 3.6 mm may achieve an $Area_{Groove}/Area_{Total}$ of 28.9% percent with an $R_{TR1}$ of 32 mm and $R_{TR2}$ of 42 mm. In the transition region, grooves 608 represent continuous arcs that intersect circular grooves 610 and 612. After extending through the transition region, grooves 608 continue through the outer region to the perimeter of the pad (not illustrated) in accordance with a groove path defined by Equation 1. Advantageously, the outer region will contain additional shorter grooves that originate from the within the outer region to balance the $Area_{Groove}/Area_{Total}$ across the wafer track. Optionally, these grooves may have staggered starting locations, uneven angular groove spacings, repeating group patterns or any combination of these features.

Figure 7:
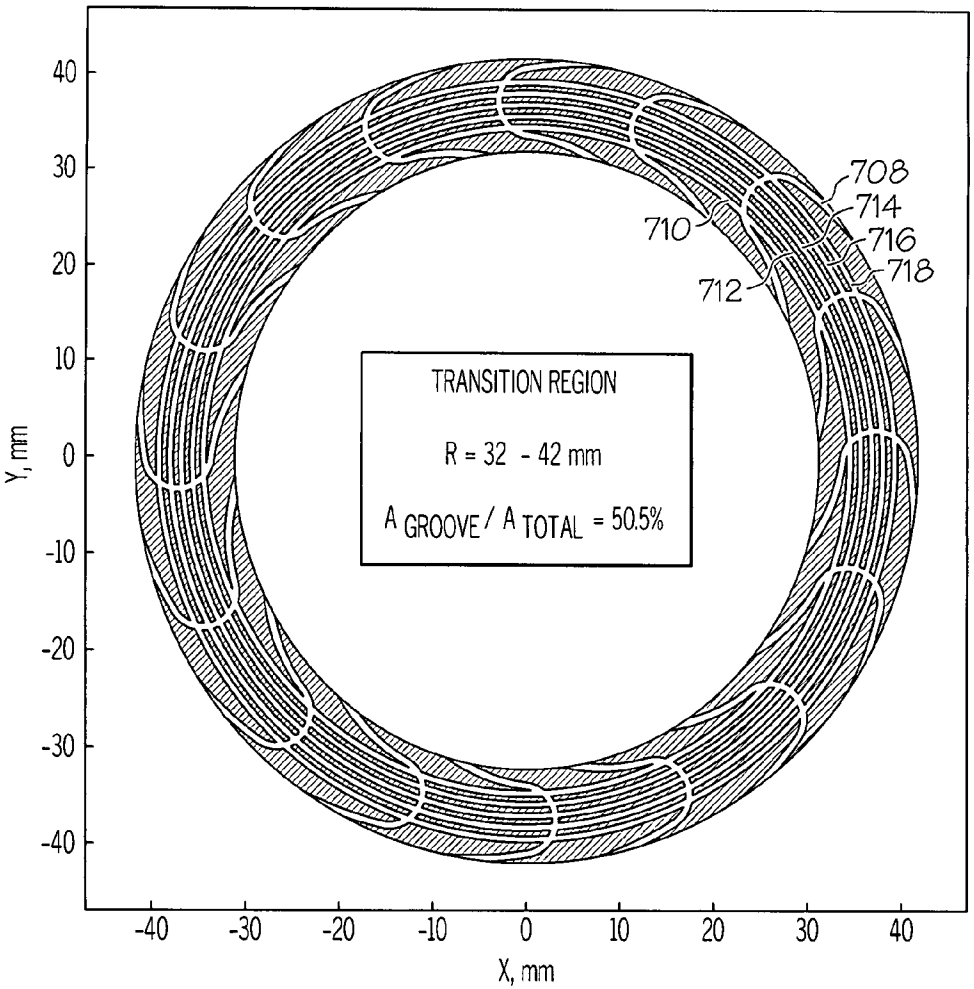
FIG. 7 is a schematic top view of a transition region having five circular grooves and arc-shaped grooves.

FIG. 7 illustrates that an optional transition region embodiment with five narrow circular grooves 710, 712, 714, 716 and 718 with a width of 0.76 mm and a pitch of 1.2 mm may achieve an $Area_{Groove}/Area_{Total}$ of 50.5% percent with an $R_{TR1}$ of 32 mm and $R_{TR2}$ of 42 mm. In the transition region, grooves 708 represent continuous arcs that intersect circular grooves 710, 712, 714, 716, and 718. After extending through the transition region, grooves 708 continue through the outer region to the perimeter of the pad (not illustrated) in accordance with a groove path defined by Equation 1. Advantageously, the outer region will contain additional shorter grooves that originate from within the outer region to balance the $Area_{Groove}/Area_{Total}$ across the wafer track. Optionally, these grooves may have staggered starting locations, uneven angular groove spacings, repeating group patterns or any combination of these features.

Figure 8:
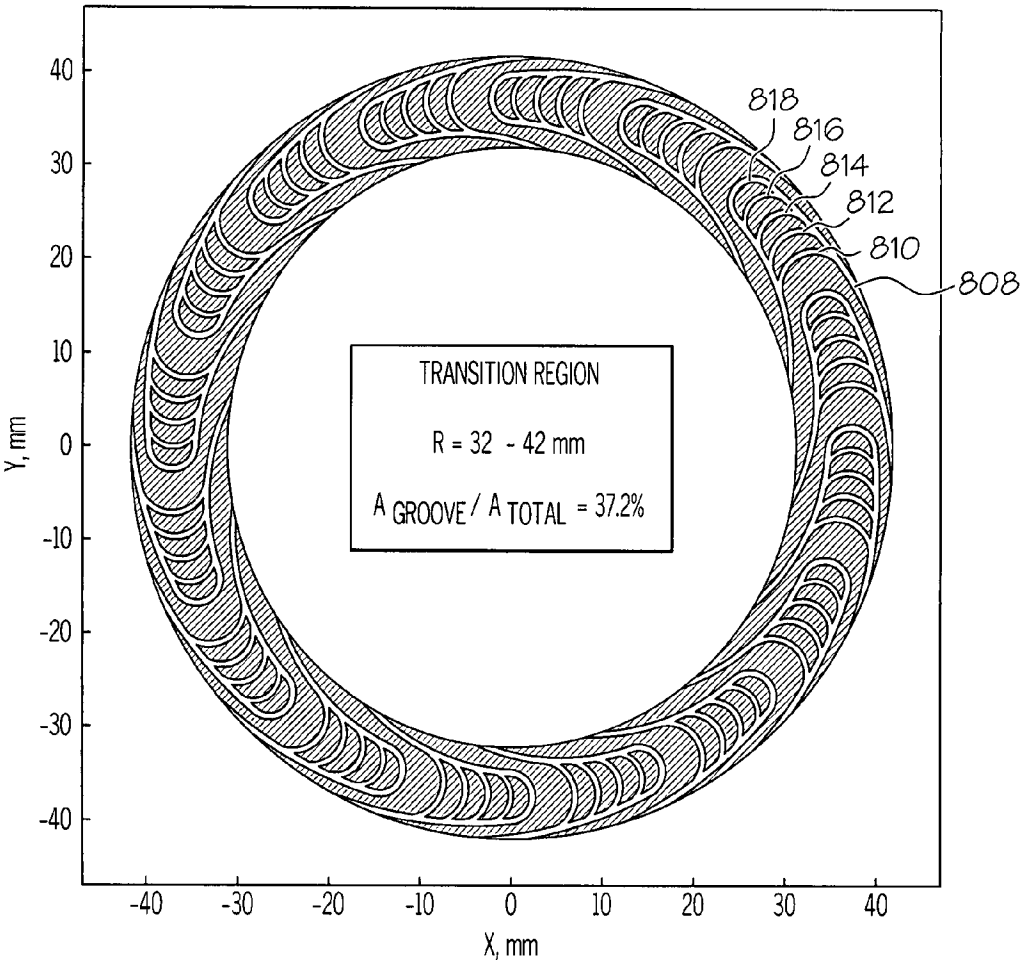
FIG. 8 is a schematic top view of a transition region having interconnected arc-shaped grooves.

FIG. 8 illustrates that an optional transition region embodiment with repeating nested arc segments with a groove width of 0.76 mm may achieve an $Area_{Groove}/Area_{Total}$ of 37.2% percent with an $R_{TR1}$ of 32 mm and $R_{TR2}$ of 42 mm. In the transition region, grooves 808 split into multiple groove arcs 810, 812, 814, 816, and 818. In addition, groove arcs 810, 812, 814, 816, and 818 most advantageously represent mirror images about r*. After extending through the transition region, grooves 808 continue through the outer region to the perimeter of the pad (not illustrated) in accordance with a groove path defined by Equation 1. Advantageously, the outer region will contain additional shorter grooves that originate from within the outer region to balance the $Area_{Groove}/Area_{Total}$ across the wafer track. Optionally, these grooves may have staggered starting locations, uneven angular groove spacings, repeating group patterns or any combination of these features.

Figure 9:
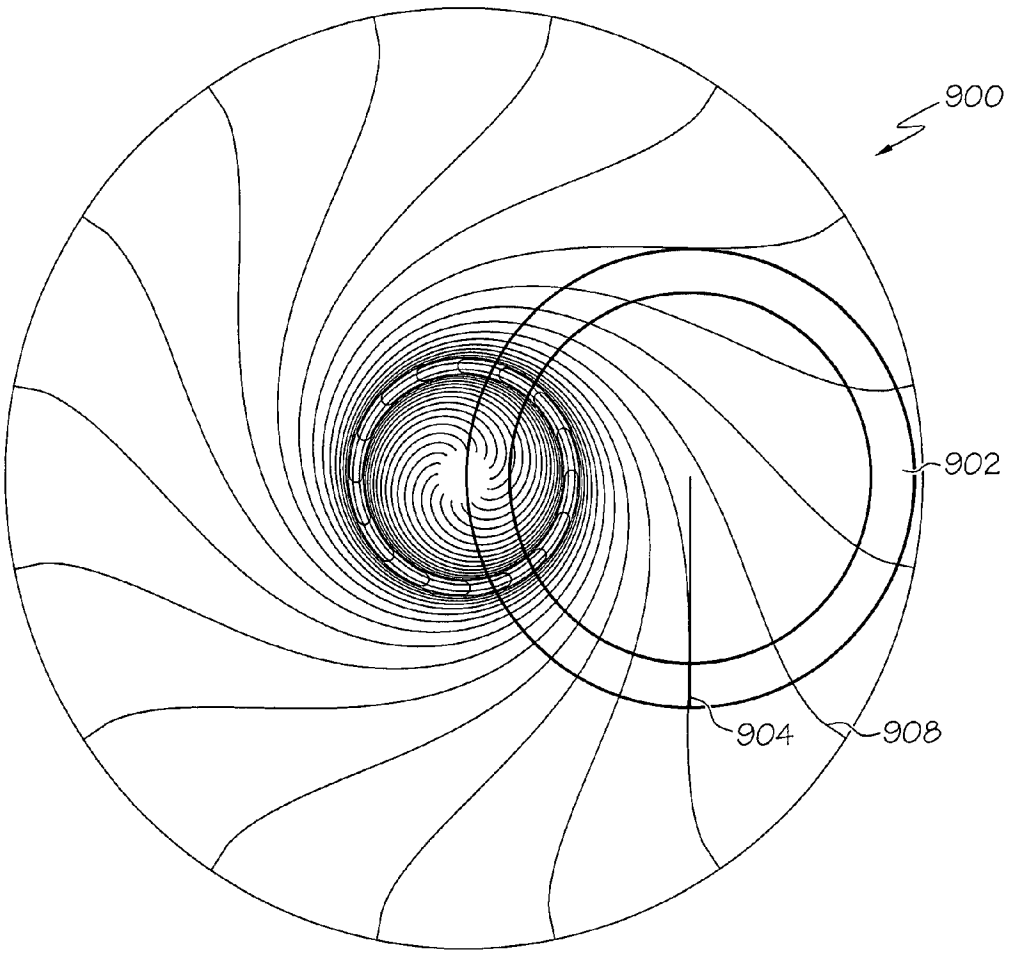
FIG. 9 is a schematic top view of the high-rate groove pattern having a carrier slot angle of 0°.
Figure 9A:
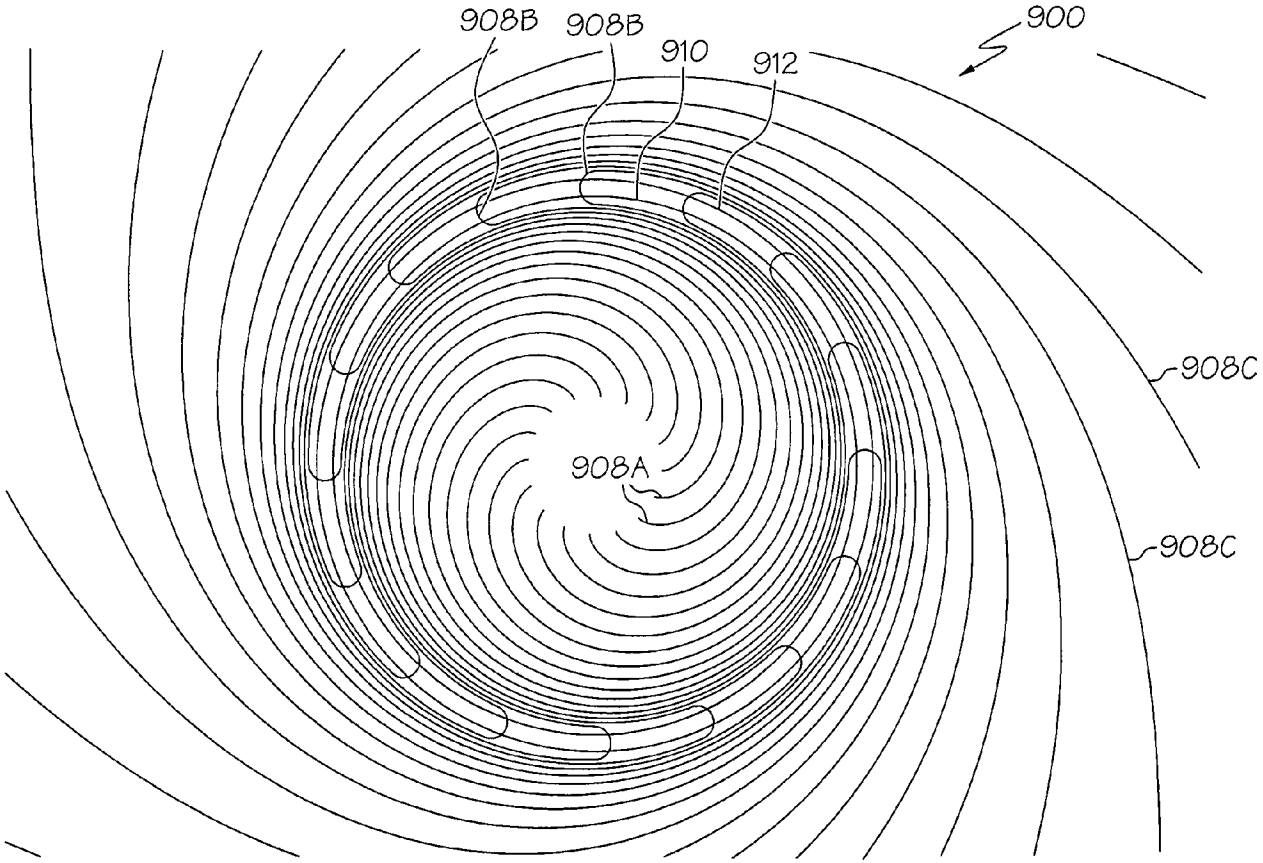
FIG. 9A is a schematic top view of the inner region, transition region and immediate outer region of FIG. 9.

Referring to FIGS. 9 and 9A, polishing pad 900 includes grooves 908 designed for a carrier ring 902 having 0° carrier grooves 904 (one illustrated). For 0° carrier grooves, the polishing pad 900 includes a relatively large inner region. Therefore, grooves 908A extend through the inner region in accordance with Equation 1, through the transition region as arc-shaped grooves 908B, and through the outer region as grooves 908C in accordance with Equation 1. In the transition region, grooves 908B extend through circular grooves 910 and 912. Alternatively, the inner region may contain spiral grooves, such as equal-area spiral grooves. But the inner region most advantageously contains grooves in accordance with Equation 1.

Figure 10:
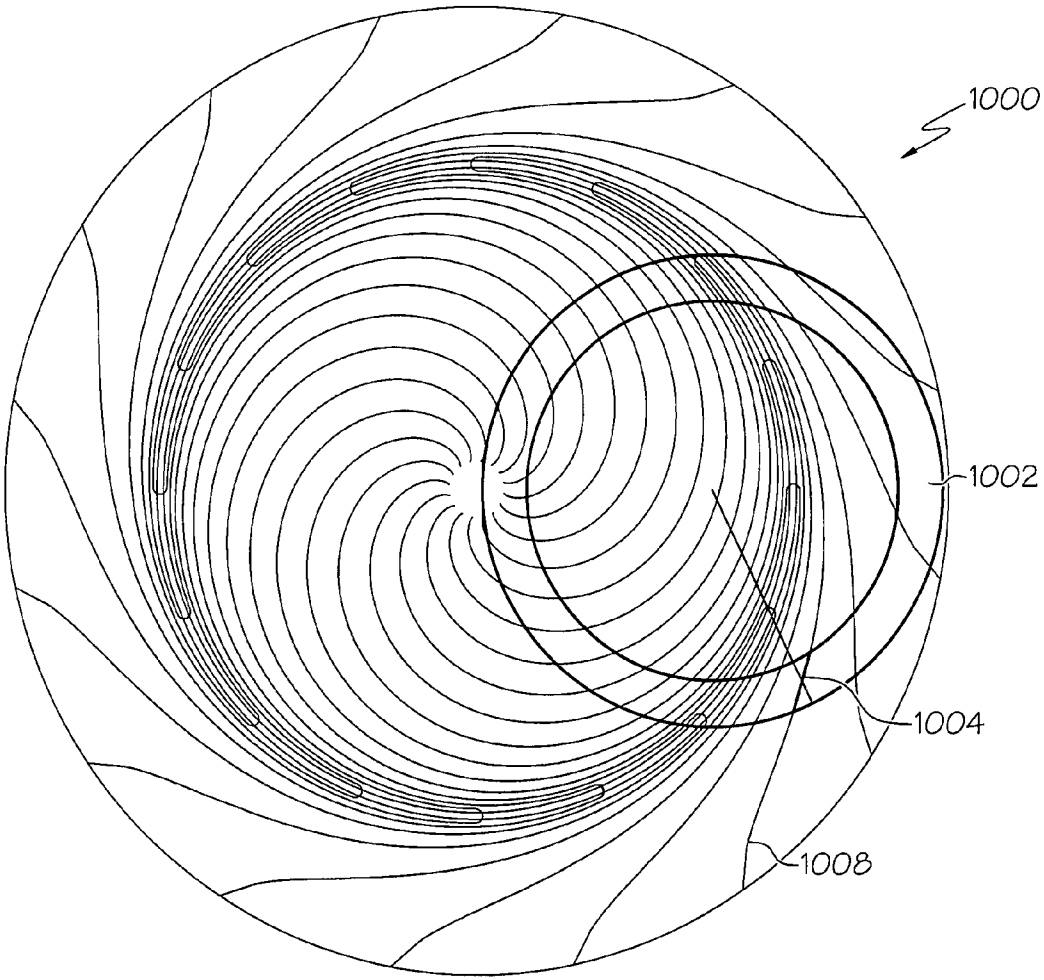
FIG. 10 is a schematic top view of the high-rate groove pattern having a carrier slot angle of −38°.
Figure 10A:
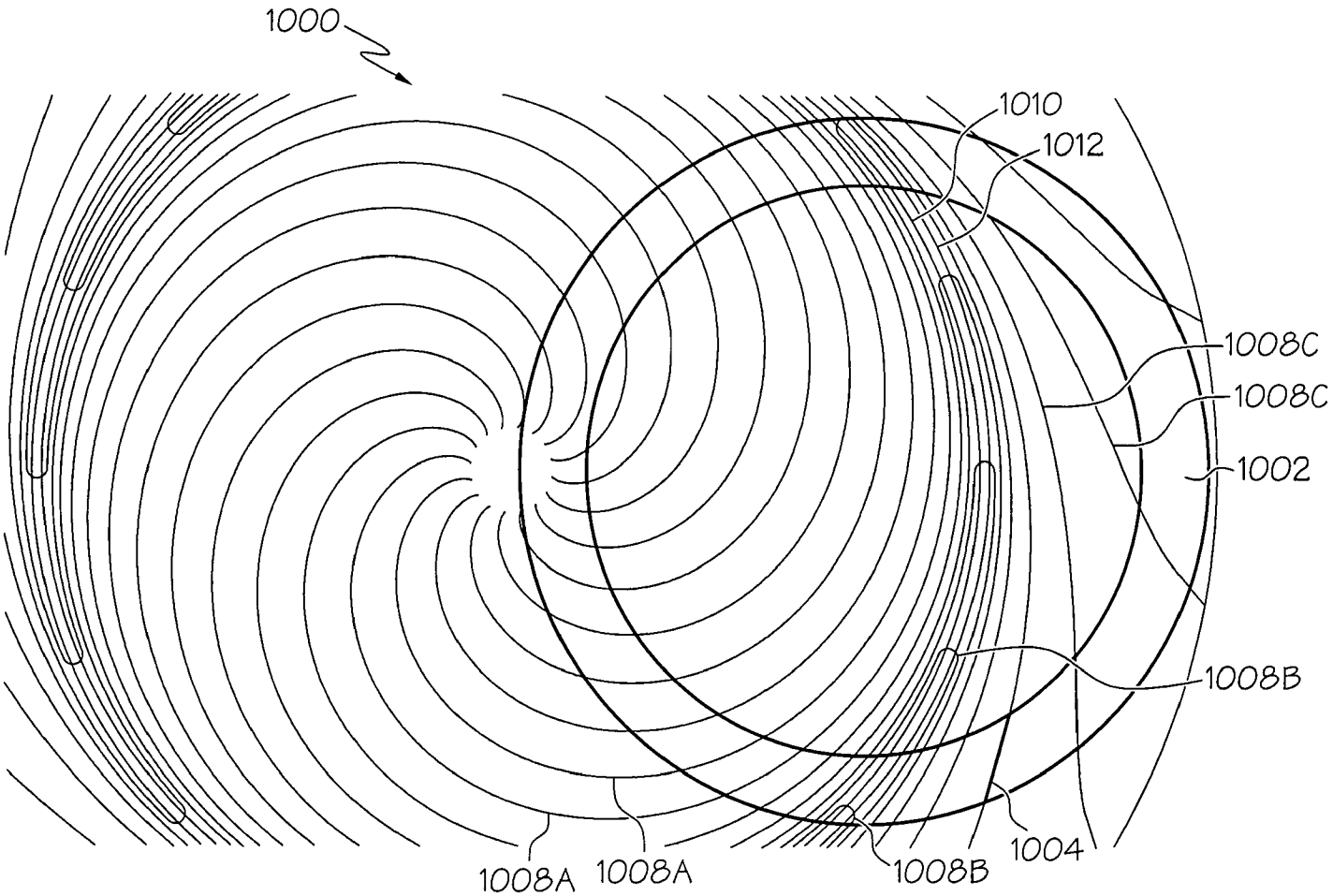
FIG. 10A is a schematic top view of the inner region, transition region and immediate outer region of FIG. 10.

Referring to FIGS. 10 and 10A, polishing pad 1000 includes grooves 1008 designed for a carrier ring 1002 having −38° carrier grooves 1004 (one illustrated). For −38° carrier grooves, the polishing pad 1000 includes a large inner region extending over more than half of the width of the wafer track. Therefore, grooves 1008A extend through the inner region in accordance with Equation 1, through the transition region as arc-shaped grooves 1008B and through the outer region as grooves 1008C in accordance with Equation 1. In the transition region, grooves 1008B extend through circular grooves 1010 and 1012. Alternatively, the inner region may contain spiral grooves, such as equal-area spiral grooves. But the inner region most advantageously contains grooves in accordance with Equation 1.

Figure 11:
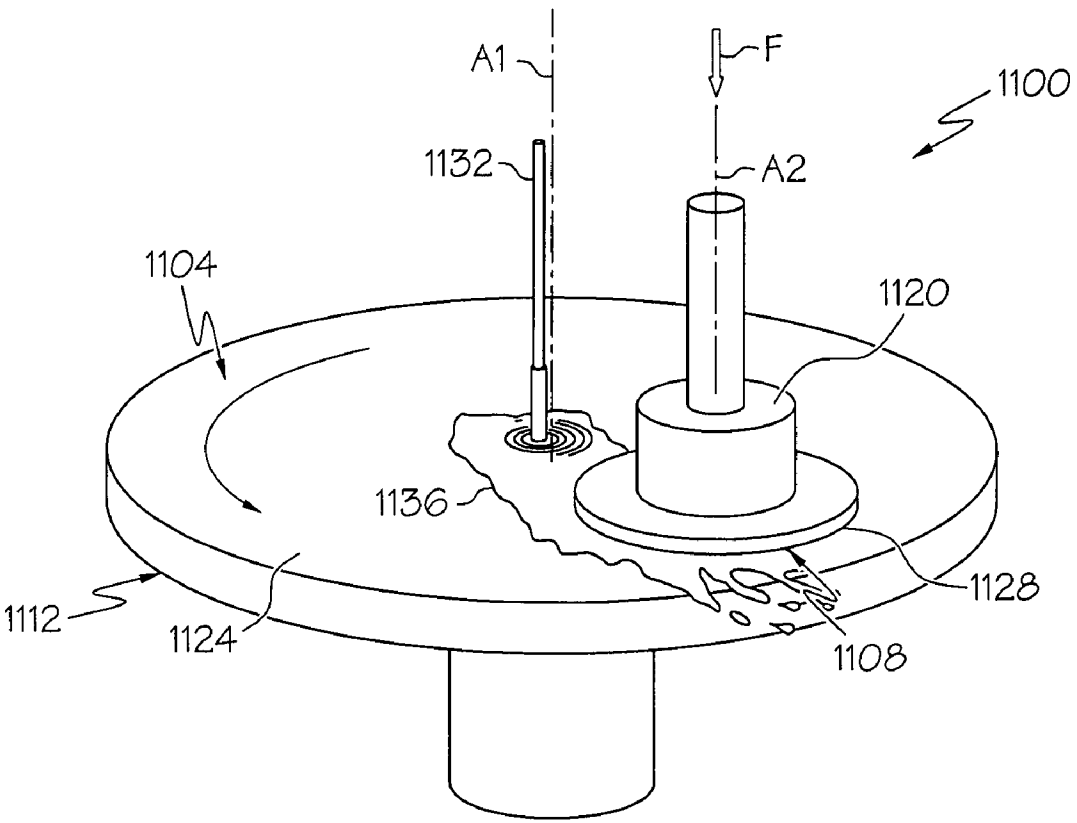
FIG. 11 is a schematic diagram of a polishing system in accordance with the present invention.

FIG. 11 illustrates a polisher 1100 suitable for use with a polishing pad 1104, which may be the polishing pads of FIGS. 5 to 10 or other polishing pads of the present disclosure, for polishing an article, such as a wafer 1108. Polisher 1100 may include a platen 1112 on which polishing pad 1104 is mounted. Platen 1112 is rotatable about a rotational axis A1 by a platen driver (not shown). Polisher 1100 may further include a wafer carrier 1120 that is rotatable about a rotational axis A2 parallel to, and spaced from, rotational axis A1 of platen 1112 and supports wafer 1108 during polishing. Wafer carrier 1120 may feature a gimbaled linkage (not shown) that allows wafer 1108 to assume an aspect very slightly non-parallel to the polishing surface 1124 of polishing pad 1104, in which case rotational axes A1, A2 may be very slightly askew relative to each other. Wafer 1108 includes a polished surface 1128 that faces polishing surface 1124 and is planarized during polishing. Wafer carrier 1120 may be supported by a carrier support assembly (not shown) adapted to rotate wafer 1108 and provide a downward force F to press polished surface 1128 against polishing pad 1104 so that a desired pressure exists between the polished surface and the pad during polishing. Polisher 1100 may also include a polishing medium inlet 1132 for supplying a polishing medium 1136 to polishing surface 1124.

As those skilled in the art will appreciate, polisher 1100 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 1108 and polishing pad 1104; (2) controllers and selectors for varying the rate and location of delivery of polishing medium 1136 to the pad; (3) controllers and selectors for controlling the magnitude of force F applied between the wafer and polishing pad, and (4) controllers, actuators and selectors for controlling the location of rotational axis A2 of the wafer relative to rotational axis A1 of the pad, among others. Those skilled in the art will understand how these components are constructed and implemented such that a detailed explanation of them is not necessary for those skilled in the art to understand and practice the present invention.

During polishing, polishing pad 1104 and wafer 1108 are rotated about their respective rotational axes A1, A2 and polishing medium 1136 is dispensed from polishing medium inlet 1132 onto the rotating polishing pad. Polishing medium 1136 spreads out over polishing surface 1124, including the gap between wafer 1108 and polishing pad 1104. Polishing pad 1104 and wafer 1108 are typically, but not necessarily, rotated at selected speeds of 0.1 rpm to 750 rpm. Force F is typically, but not necessarily, of a magnitude selected to induce a desired pressure of 0.1 psi to 15 psi (6.9 to 103 kPa) between wafer 1108 and polishing pad 1104. The carrier groove-pad groove alignment and high groove area in the transition region can result in a substantial increase in substrate removal rate.

EXAMPLE

In this example, IC1000 polyurethane polishing pads manufactured by Rohm and Haas Electronic Materials CMP Technologies, Newark, Del., USA with groove patterns having varied transition regions demonstrate the efficacy of continuous grooves through the transition region and a large groove area in the transition region. In this example, 77.5-cm diameter hard polyurethane pads grooved to a depth of 0.76 mm and width of 0.76 mm provided comparative examples. Two pads of each groove pattern were tested. In particular, polishing tungsten blanket wafers with a downforce of 26.6 kPa, a pad rotation rate of 120 rpm, a carrier rotation rate of 113 rpm, and a slurry flow rate of 120 ml/min., produced the results of Table 1. Mean values refer to the arithmetic average of the results obtained with the two pads of each type.

TABLE 1

| Transition Region Groove Type and Reference Figure(s) | Ratio of Groove Area to Total Area (%) | Mean CMP Removal Rate (Å/min) | Mean Wafer-to-Wafer Non-Uniformity (%) | Mean Within-Wafer Non-Uniformity (%) | Mean Pad Surface Temperature at Polish Endpoint (° C.) | Mean Chatter Mark Count |
|---|---|---|---|---|---|---|
| Trough FIGS. 4, 4A | 57.6 | 4321 | 4.9 | 4.4 | 162 | 6 |
| Wide Circle FIGS. 5, 5A | 56.8 | 4355 | 1.5 | 3.8 | 159 | 5 |
| Multiple Circle FIG. 6 | 28.9 | 4244 | 4.1 | 4.1 | 159 | 5 |
| Multiple Arc FIG. 8 | 37.2 | 4971 | 0.7 | 3.6 | 156 | 7 |

Relative to the original transition region groove pattern of FIGS. 4 and 4A containing the converging groove paths intrinsic to Equation 1, the transition region groove of FIGS. 5 and 5A lowered mean endpoint polishing temperature by 3° C., reduced mean wafer-to-wafer rate variation from 4.9 to 1.5%, and reduced mean within-wafer-non-uniformity from 4.4 to 3.8%. Similarly, the transition region groove of FIG. 6 lowered mean endpoint polishing temperature by 3° C., reduced mean wafer-to-wafer rate variation from 4.9 to 4.1%, and reduced mean within-wafer-non-uniformity from 4.4 to 4.1%. The shifts in mean removal rate and mean chatter mark count among these cases are not considered significant. Finally, the multiple arc transition region groove of FIG. 8 increased mean removal rate by 15%, lowered mean endpoint polishing temperature by 6° C., reduced mean wafer-to-wafer rate variation from 4.9 to 0.7%, and reduced mean within-wafer-non-uniformity from 4.4 to 3.6%; the one-number increase in chatter marks is not considered significant.

The three-region polishing pads of the invention provide high removal rates with improved polishing characteristics. For example, the polishing pads can increase removal rate or improve within-wafer-non-uniformity. In addition, it is possible to adjust removal rate by adjusting the groove area ratio in the polishing pad and to fine tune removal rate by adjusting groove area ratio in the transition region.

The invention claimed is:

1. A polishing pad useful for polishing at least one of a magnetic, optical and semiconductor substrate in the presence of a polishing medium with a polishing pad, the polishing pad comprising:

a center, an inner region surrounding the center, a transition region connecting grooves from the inner region to an outer region surrounding the inner region, the outer region having multiple grooves, the multiple grooves having a high-rate path, at least fifty percent of the high-rate path being within twenty percent of a groove trajectory $\phi(r)$ in polar coordinates referenced to the concentric center of the polishing pad and defined in terms of (1) the distance R between the concentric center of the polishing pad and the rotational center of the substrate being polished, (2) the radius $R_c$ of the carrier fixture, and (3) the local angle $\theta_{c0}$ of grooves in the carrier fixture, defined with a groove equation as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ the transition region being adjacent the outer region and within a radius from the center defined as follows:

$$r_{TR} = 0.7r^* \text{ to } 1.3r^*$$

where

-continued $$r^* = R_C\sqrt{\left(\frac{R}{R_C}\right)^2 - \cos(2\theta_{c0}) - \sin(2\theta_{c0})\sqrt{\left(\frac{R/R_C}{\cos\theta_{c0}}\right)^2 - 1}}\ ;$$

and wherein the inner region originates continuous grooves that extend uninterrupted to the outer region.

2. The polishing pad of claim 1 wherein the transition region includes arc-shaped grooves.

3. The polishing pad of claim 1 wherein the inner region has a groove path that is within twenty percent of the groove equation.

4. The polishing pad of claim 1 wherein the groove trajectory defined by the equation is from the $\theta_{c0}$ value being 0 to 90 degrees.

5. A polishing pad useful for polishing at least one of a magnetic, optical and semiconductor substrate in the presence of a polishing medium with a polishing pad, the polishing pad comprising:

a center, an inner region surrounding the center, a transition region connecting grooves from the inner region to an outer region surrounding the inner region, the outer region having multiple grooves, the multiple grooves having a high-rate path, at least fifty percent of the high-rate path being within ten percent of a groove trajectory $\phi(r)$ in polar coordinates referenced to the concentric center of the polishing pad and defined in terms of (1) the distance R between the concentric center of the polishing pad and the rotational center of the substrate being polished, (2) the radius $R_c$ of the carrier fixture, and (3) the local angle $\theta_{c0}$ of grooves in the carrier fixture, defined with a groove equation as follows:

$$\phi(r) = \int_{R-R_C}^{r} \frac{\frac{R}{R_C}\sin\phi_c + (\tan\theta_{c0})\left(\frac{R}{R_C}\cos\phi_c + 1\right)}{\left(\frac{R}{R_C}\cos\phi_c + 1\right) - (\tan\theta_{c0})\frac{R}{R_C}\sin\phi_c}\frac{dr'}{r'}$$

where $$\phi_c = \cos^{-1}\left(\frac{R^2 + R_C^2 - r^2}{2RR_C}\right) - \pi$$

for values of $r$ from $(R - R_C)$ to $(R + R_C)$ the transition region being adjacent the outer region and within a radius from the center defined as follows:

$$r_{TR} = 0.8r^* \text{ to } 1.2r^*$$

where $$r^* = R_C\sqrt{\left(\frac{R}{R_C}\right)^2 - \cos(2\theta_{c0}) - \sin(2\theta_{c0})\sqrt{\left(\frac{R/R_C}{\cos\theta_{c0}}\right)^2 - 1}}\ ;$$

and wherein the inner region originates continuous grooves that extend uninterrupted to the outer region and the transition region has an $\text{Area}_{Groove}/\text{Area}_{Total}$ of 25 to 75 percent.

6. The polishing pad of claim 5 wherein the transition region includes arc-shaped grooves.

7. The polishing pad of claim 5 wherein the inner region has a groove path that is within twenty percent of the groove equation.

8. The polishing pad of claim 5 wherein the transition region includes circular-shaped grooves.

9. The polishing pad of claim 5 wherein the groove trajectory defined by the equation is from the $\theta_{c0}$ value being 30 to 60 degrees.

10. The polishing pad of claim 5 wherein the groove trajectory defined by the equation is from the $\theta_{c0}$ value being 40 to 50 degrees.

* * * * *